US005409118A

United States Patent [19]

Bielagus et al.

[11] Patent Number: 5,409,118

[45] Date of Patent: Apr. 25, 1995

[54] OPEN AIR DENSITY SEPARATOR AND METHOD

[75] Inventors: Joseph B. Bielagus, Tualatin; Richard J. Gobel, Scappoose, both of Oreg.

[73] Assignee: Beloit Technologies, Inc., Wilmington, Del.

[21] Appl. No.: 306,354

[22] Filed: Sep. 15, 1994

[51] Int. Cl.[6] ..... B07B 4/00

[52] U.S. Cl. ..... 209/136; 209/140; 209/147; 209/913

[58] Field of Search ..... 209/136, 137, 140, 141, 209/143, 147, 154, 913

[56] References Cited

U.S. PATENT DOCUMENTS

| | | | |
|---|---|---|---|
| 1,126,240 | 1/1915 | McKenzie | 209/137 |
| 1,530,277 | 3/1925 | Mettler, Sr. | 209/137 |
| 1,987,640 | 1/1935 | Rothgarn | 209/136 |
| 2,162,392 | 6/1939 | Solomon, Jr. et al. | 209/137 |
| 2,203,959 | 6/1940 | Hammack | 209/137 |
| 2,316,451 | 4/1943 | Page | 209/137 X |
| 2,643,769 | 6/1953 | Tanner | 209/137 X |
| 2,828,011 | 3/1958 | Whitby . | |
| 3,262,457 | 7/1966 | Gamberini | 209/137 X |
| 3,378,140 | 4/1968 | Wochnowski et al. | 209/137 |
| 3,384,233 | 5/1968 | Bolles . | |
| 3,397,780 | 8/1968 | Beuzeval | 209/137 |
| 3,907,670 | 9/1975 | Fernandes | 209/137 |
| 4,089,422 | 5/1978 | Harmke et al. | 209/137 |
| 4,166,027 | 8/1979 | Smith . | |
| 4,465,194 | 8/1984 | Coleman . | |
| 4,486,300 | 12/1984 | Prieb . | |
| 4,915,824 | 4/1990 | Surtees | 209/137 X |
| 5,110,453 | 5/1992 | Montgomery . | |

FOREIGN PATENT DOCUMENTS

| | | |
|---|---|---|
| 0400326 | 3/1909 | France . |
| 0545573 | 10/1922 | France . |
| 0828125 | 5/1938 | France . |
| 1181399 | 6/1959 | France . |
| 0574908 | 8/1942 | United Kingdom . |
| 8706506 | 11/1987 | WIPO . |

*Primary Examiner*—D. Glenn Dayoan

*Attorney, Agent, or Firm*—Dirk J. Veneman; Raymond W. Campbell

[57] ABSTRACT

A chamber has an aperture which opens downwardly to the atmosphere and an upwardly opening air return passage. A nozzle-forming duct is inclined upwardly at approximately sixty degrees to the horizontal, and a fan mounted therein directs moving air into the chamber. An upwardly inclined ramp is positioned within the duct, and communicates between the chamber and a downwardly opening hole in the floor of the duct. A metered supply of wood chips is fed down a sixty degree incline onto the ramp through the air stream which is moving through the duct. Lightweight chips become entrained in the air and are separated from the rocks, tramp metal and knots which slide down the inclined surface and exit through a hole in the duct. The entrained wood chips, together with the air from the fan, are directed into a curved baffle spaced within the chamber. By forcing the air and chips to move in a curved path, the curved baffle uses centrifugal force to separate the chips from the air stream. As the air stream expands into the chamber, its velocity drops then passes through the chip stream up to an air return. The chips, under the force of gravity, continue their downward flight, and exit the chamber through the bottom opening. An inclined ramp with a slowly moving conveyor may be used to avoid a build-up of material on the inclined ramp.

16 Claims, 2 Drawing Sheets

OPEN AIR DENSITY SEPARATOR AND METHOD

FIELD OF THE INVENTION

The present invention relates to wood chip cleaning and separating apparatus in general. More particularly, the present invention relates to apparatus which utilize a current of air to separate rocks, tramp metal and knots from desirable wood chips.

BACKGROUND OF THE INVENTION

In the production of paper from wood fibers, the wood fibers must be freed from the raw wood. One widely used method of accomplishing this is to process the wood fibers in a cooking liquor so that the material holding the fibers together, lignin, is dissolved. In order to achieve rapid and uniform digestion by the cooking liquor, the wood, after it has been debarked, is passed through a chipper which reduces the raw wood to chips.

As a natural consequence of the harvesting and processing of pulp logs, some rocks and tramp metal find their way into the raw wood chips. Further, a certain percentage of the raw wood is comprised of knots which are in general undesired in the papermaking process because they add dark fibers which increase the bleaching requirement and because they contain resinous material. The knots, which are typically of a higher density because the wood is dense and resinous, together with tramp metal and rocks, must be separated from the raw wood chips before further processing.

One highly successful method of accomplishing this separation is the air density separator. In one known successful system, chips are supplied by a metering screw conveyor infeed to a separation chamber through which a stream of air is drawn. The chips are entrained in the air stream while the higher density knots, stones and tramp metal move against the current of air under the force of gravity. The acceptable chips and air then pass into a cyclone where the chips are separated from the air, the air being drawn by a vacuum into a fan and exhausted.

While the air density separator is the most effective and discriminating system available, it has some less desirable features. First, it requires an air lock for the removal of the accepted chips from the cyclone. The discharge air lock is expensive to maintain and prone to plugging on long stringy materials. Second, while the known air density separators can lower costs because of the complete freedom of the placement of the process equipment, the equipment can nevertheless occupy a substantial area within the chip processing plant. Third, the air density separator consumes considerable energy.

What is needed is an air density separator which functions without an air lock, is more compact in design, and is more energy efficient.

SUMMARY OF THE INVENTION

The air density apparatus of this invention provides cost-effective particle separation by eliminating the requirement for a wood chip air lock and reducing power consumption. The invention employs a chamber which has an aperture which opens downwardly to the atmosphere and an upwardly opening air return passage. A fan is mounted in a nozzle-forming duct which is inclined upwardly at approximately sixty degrees to the horizontal. The fan provides a source of moving air which is directed through the duct into the chamber.

An upwardly inclined ramp is positioned within the duct. The inclined ramp communicates between the chamber and a downwardly opening hole in the floor of the duct.

A thinly dispersed, metered supply of wood chips is fed down a sixty degree incline onto the ramp through the air stream which is moving through the duct. The lightweight chips become entrained in the air and are separated from the rocks, tramp metal, and knots. The dense rocks, tramp metal and knots slide down the inclined surface and exit through the hole in the duct. The entrained wood chips, together with the air from the fan, are directed into a curved baffle spaced within the chamber. By forcing the air and chips to move in a curved path, the curved baffle uses centrifugal force to separate the chips from the air stream. As the air stream expands into the chamber, its velocity drops. The low velocity air then passes through the chip stream up to an air return. The chips, under the force of gravity, continue their downward flight, where they exit the chamber through the bottom opening.

In some circumstances it is desirable to replace the inclined ramp with a slowly moving conveyor to avoid a build-up of material on the inclined ramp. A knot of intermediate density may become balanced between the downward force of gravity and the upward force of air from the fan. In this balanced position on the ramp the knot creates a break in the stream of air which allows other material to become trapped behind it. The downward motion of the inclined conveyor assures that all the material on the ramp progresses to the waste chute. Further, the duct is converging so that the forward motion of the conveyor moves the knot or wood chip into air of decreased velocity where it may readily tumble down the conveyor's surface.

It is a feature of the present invention to provide an air density separator of compact design.

It is another feature of the present invention to provide an air density separator which avoids an outfeed air lock.

It is a further feature of the present invention to provide an air density separator which operates with lower power.

Further features and advantages of the invention will be apparent from the following detailed description when taken in conjunction with the accompanying drawings.

DESCRIPTION OF THE PREFERRED EMBODIMENTS

Figure 1:
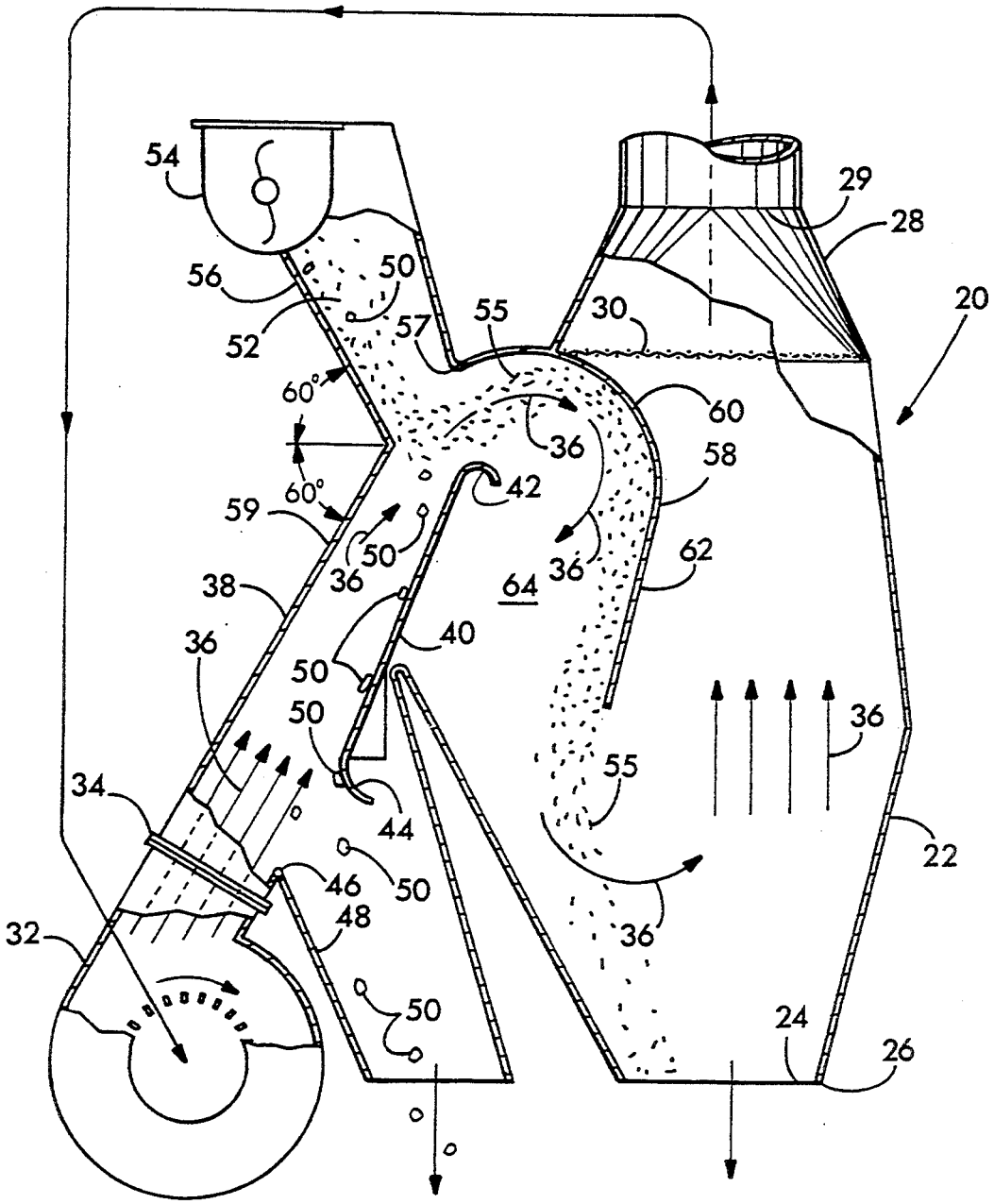
FIG. 1 is a somewhat schematic cross-sectional view of the air density separator apparatus of this invention.
Figure 2:
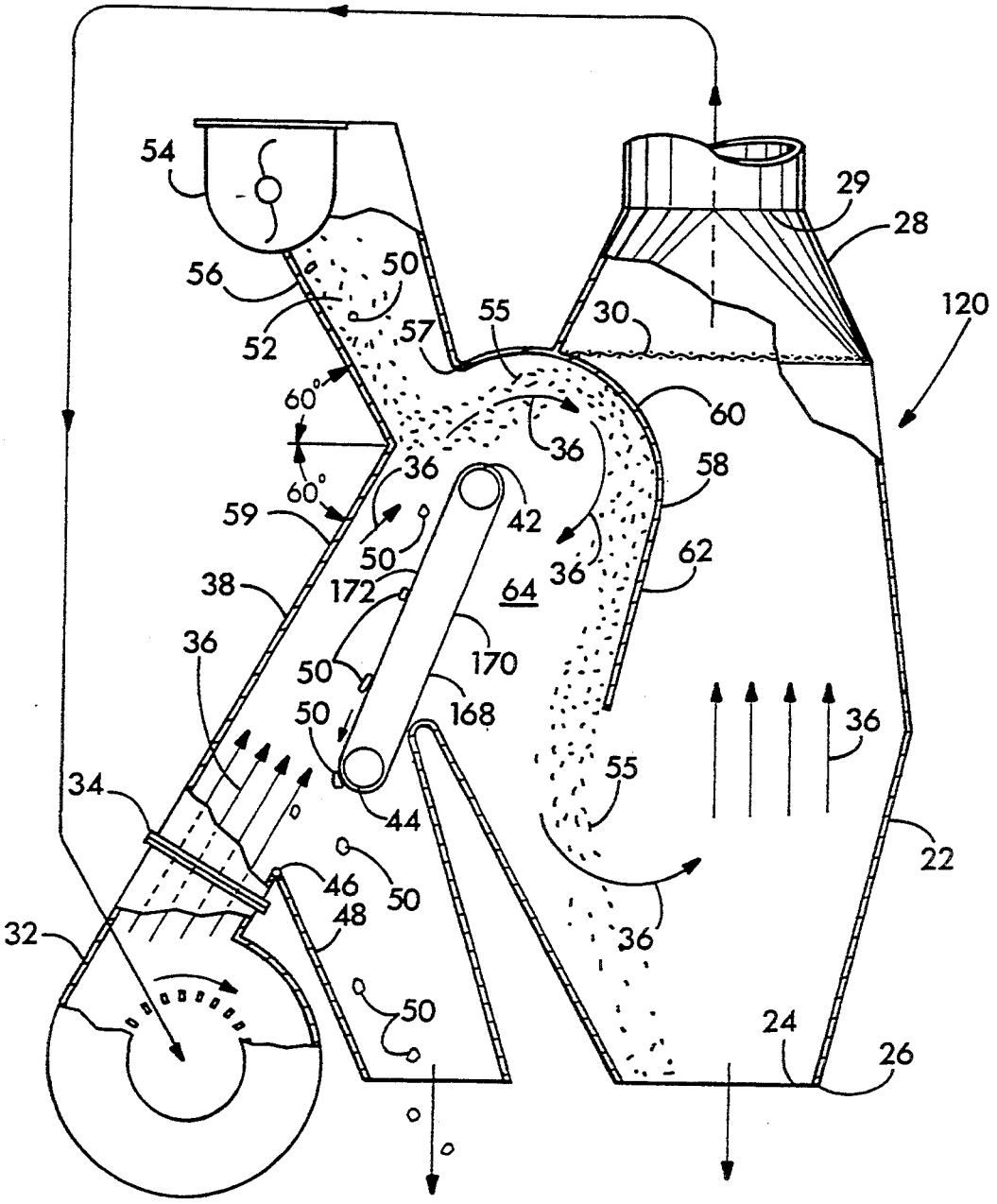
FIG. 2 is a somewhat schematic cross-sectional view of an alternative embodiment of the air density separator of this invention.

Referring more particularly to FIGS. 1 and 2, wherein like numbers refer to similar parts, an air density separator apparatus 20 is shown in FIG. 1. The air density separator 20 is primarily designed for use in cleaning chips directly from the chipper (not shown), which produces chips directly from the debarked pulpwood.

The air density separator 20 has air and chip separation chamber 22. The chamber 22 has a chip outlet 24 which is open to the atmosphere and is located at the bottom 26 of the chamber 22. The chamber 22 has an air return plenum 28 at the top 29. A screen 30 may be placed below the air plenum to prevent plastic and the like from passing through the return plenum to the fan 32. The fan 32 is a typical industrial high velocity centrifugal fan. It is equipped with a damper 34 for controlling the velocity of the air leaving the fan 32. The air, indicated by arrows 36, moves up a duct 38 which in inclined sixty degrees from the horizontal toward and into the chamber 22.

Disposed within the air stream indicated by arrows 36 is a ramp 40 which is inclined toward the chamber 22. The upper end 42 of the ramp 40 extends into the chamber 22. The lower end 44 of the ramp 40 terminates adjacent a discharge opening 46 in the duct 38. The discharge opening 46 opens into a chute 48 which provides an exit for tramp, rocks, and knots 50. A supply of raw wood chips 52 is fed from a distributing screw conveyor 54 down a supply chute 56. The supply chute 56 is downwardly inclined at sixty degrees from the horizontal and joins the duct 38 at an opening 57. The supply chute 56 and the outer wall 59 of the duct 38 meet at an angle of approximately one-hundred-and-twenty degrees. The chip supply screw 54 forms an air lock closed to the atmosphere, so that no or little air leaks up through the chute 56. The downwardly moving chips 52 encounter a stream of air shown by arrows 36, where the desirable chips become entrained in the air and are blown up the duct 38 into the chamber 22.

Rocks, tramp metal and undesirable knots, being of higher density, under the influence of gravity penetrate the air stream and become lodged on the inclined ramp 40. Under the force of gravity, they move downwardly to the reject opening 46 and hence through the reject passage 48 and out of the separator. The desired wood chips and the air stream indicated by arrows 36 are directed into a circular path by a baffle 58 positioned within the chamber 22. The baffle 58 forces the air stream and entrained, acceptable chips 55 to follow a curved path. The chips follow Newton's first law directing, that a particle in linear motion will continue in that motion unless operated on by a force. Thus, the chips continue on until they come into contact with the curved section 60 of the curved baffle 58.

The air experiences a decrease in velocity and some increase in pressure caused by the turning about the curved section 60 of the baffle 58. Once the chips 55 reach the straight section 62 of the curved baffle 58, the chips 55 continue down the inclined side of the baffle straight section 62. At the same time the air expands into the space 64 adjacent to the straight section 62. As the air expands and moves away from the chips it decreases in velocity. The lower velocity air then passes through the stream of downwardly cascading chips 55 where it is drawn upwardly into the air return plenum 28. The chips 55 continue their downward fall and are removed through the bottom opening 24 of the air density separator 20. The clean chips 55 are then sent to a chip slicer or chip conditioner for further processing.

FIG. 2 shows an alternative embodiment air density separator 120, which incorporates a conveyor belt 168 instead of the inclined plane. The conveyor belt 168 overcomes a problem associated with the inclined ramp 40. That is, a knot or the like of intermittent density may reach a stable position on the inclined ramp 40, where the downward force of gravity is just balanced by the upward force of moving air indicated by arrows 36. If a chip of intermediate density reaches such a stable position on the ramp 40, it can provide a wind screen which will allow other chips to build up behind it. This undesirable effect may be overcome by providing a conveyor 168 which has a belt 170. The conveyor moves in a generally downward direction, thus assuring that materials which become lodged on the upper surface 172 progress downwardly to the over-sized chip exit 46.

Although a conventional conveyor is shown, a vibrating conveyor could be employed. Further, other means for preventing chip build-up would include oscillating the inclination angle of the inclined plane or periodically varying the air velocity produced from the blower by means of the damper 34.

The damper 34 may be used to tune the air density separator 20 as shown in FIG. 1, to allow the separation of knots from the chip stream 52. Tramp metal and rocks, having much higher density than wood chips, are readily separated. The separation of knots, however, requires more careful tuning to assure an acceptable fractionation of the undesirable knot-containing chips.

It should be understood that wherein the air is shown recirculating from the chamber 22 to the fan 32 by way of a duct, the air chamber could simply vent upwardly and downwardly to the atmosphere.

It should also be understood that wherein a damper 34 is shown controlling the flow of air, the air flow could be controlled by variable vanes within the fan, or by a speed controller on the fan motor. It should be noted, in actual practice the air density separator 20 requires about seventy-five horsepower to drive the fan, where a comparable conventional air density separator would have required one-hundred-and-fifty horsepower.

It is understood that the invention is not confined to the particular construction and arrangement of parts herein illustrated and described, but embraces all such modified forms thereof as come within the scope of the following claims.

We claim:

1. An air density separator comprising:

a chamber open to the atmosphere;

a duct which extends upwardly and discharges into the chamber;

lower portions of the duct which define an opening for the discharge under the influence of gravity of greater density material, a source of moving air which directs air upwardly into the duct;

an upwardly inclined ramp positioned within the duct above the duct opening, wherein air is directed over the ramp by the source of moving air, wherein the ramp extends within the duct;

a supply of material positioned above the ramp to feed material on to the ramp; and a curved baffle having an inlet and an outlet, the baffle being positioned within the chamber with the inlet above the ramp and in communication with the duct, wherein the baffle curve directs moving air and any entrained material about a downwardly curved path, so causing any entrained material to move toward the baffle where it may be separated from the moving air, wherein material of greater density is separated from other material in the duct and said greater density material is discharged through the duct discharge opening.

2. The apparatus of claim 1 wherein the upwardly inclined ramp is formed by the upper surface of a conveyor, the upward surface being downwardly moveable to prevent the build-up of high density materials thereon.

3. The apparatus of claim 1 further comprising a damper positioned between the source of air and the duct, wherein the damper controls the velocity and quantity of air admitted to the duct.

4. The apparatus of claim 1 wherein a distributing screw meter admits the supply of material to the duct.

5. The apparatus of claim 1 wherein the supply of material discharges into an inclined chute which discharges material into the duct, and wherein the chute is inclined downwardly at approximately sixty degrees from a horizontal plane.

6. The apparatus of claim 1 wherein the curved baffle has a circular section which extends from above the ramp, and a straight section which extends downwardly at an angle inclined toward the duct into the chamber, the inclined straight extension providing a sliding surface for wood chips.

7. The apparatus of claim 1 further comprising an air return duct positioned above the curved baffle and communicating with the fan intake.

8. The apparatus of claim 7 further comprising a screen positioned below the air return duct for removing air-borne oversize particles from the returned air.

9. An air density separator for wood chips comprising:

a chamber, having a downwardly positioned opening, which is open to the atmosphere;

a source of moving air directed upwardly through a duct into the chamber, wherein the duct has portions which define a downwardly facing opening which is open to the atmosphere for the removal of rocks, knots and tramp;

an upwardly inclined ramp within the duct over which the source of moving air is directed, the ramp extending between the duct downward opening and the chamber;

a metering supply for wood chips positioned above the ramp to feed material through the path of the moving air and onto the ramp; and a curved baffle having an inlet and an outlet, the baffle being positioned within the chamber with the inlet above and in front of the ramp, the baffle being curved for directing moving air and any entrained wood chips about a downwardly curved path, wherein the outlet of the baffle directs wood chips out the chamber downwardly positioned opening, and wherein the curved baffle causes entrained wood chips to move toward the baffle where they may be separated from the moving air.

10. The apparatus of claim 9 wherein the upwardly inclined ramp is formed by the upper surface of a conveyor, the upper surface being downwardly moveable to convey dense particles to the duct downward opening to prevent the build-up of high density materials thereon.

11. The apparatus of claim 9 further comprising a damper positioned between the fan and the duct, wherein the damper is adjustable to control the velocity and quantity of air admitted to the duct.

12. The apparatus of claim 9 wherein the metering supply is comprised of a distributing screw meter.

13. The apparatus of claim 9 wherein the metering supply of material is positioned to feed material down an inclined chute, and wherein chute is inclined downwardly at approximately sixty degrees from a horizontal plane.

14. The apparatus of claim 9 wherein the curved baffle has a circular section which extends from above and in front of the ramp, and a straight section which extends downwardly at a steep angle into the chamber, the downward straight section providing a sliding surface for wood chips.

15. The apparatus of claim 9 further comprising an air return duct positioned at the chamber top and communicating with the fan intake.

16. The apparatus of claim 15 further comprising a screen positioned below the air return duct for removing airborne plastic and the like from the air flow.

* * * * *